US008479326B1

(12) United States Patent
Roberts et al.

(10) Patent No.: US 8,479,326 B1
(45) Date of Patent: Jul. 9, 2013

(54) REHABILITATION AND PHYSICAL THERAPY DEVICE

(71) Applicants: Lee Roberts, Kennewick, WA (US); Kirk Holle, Kennewick, WA (US); Scott Roberts, Pasco, WA (US)

(72) Inventors: Lee Roberts, Kennewick, WA (US); Kirk Holle, Kennewick, WA (US); Scott Roberts, Pasco, WA (US)

( * ) Notice: Subject to any disclaimer, the term of this patent is extended or adjusted under 35 U.S.C. 154(b) by 0 days.

(21) Appl. No.: 13/684,683

(22) Filed: Nov. 26, 2012

Related U.S. Application Data

(60) Provisional application No. 61/608,404, filed on Mar. 8, 2012.

(51) Int. Cl.
*A61G 7/10* (2006.01)

(52) U.S. Cl.
USPC ..... 5/81.1 HS; 5/81.1 R; 5/925; 5/926

(58) Field of Classification Search
USPC ..... 5/81.1 HS, 81.1 T, 81.1 R, 925, 926, 5/653
See application file for complete search history.

(56) References Cited

U.S. PATENT DOCUMENTS

| | | | | | |
|---|---|---|---|---|---|
| 1,334,901 | A | * | 3/1920 | Higdon | 5/500 |
| 2,061,664 | A | * | 11/1936 | Lincoln | 5/653 |
| 3,323,151 | A | * | 6/1967 | Lerman | 5/722 |
| 3,829,914 | A | | 8/1974 | Treat | |
| 4,048,681 | A | | 9/1977 | Baulch | |
| D267,028 | S | | 11/1982 | Spisak | |
| D279,810 | S | | 7/1985 | Noble | |
| D319,272 | S | | 8/1991 | Rushatz | |
| D356,705 | S | * | 3/1995 | Aston | D6/502 |
| 5,572,758 | A | * | 11/1996 | Merritt | 5/653 |
| D391,111 | S | * | 2/1998 | Graebe et al. | D6/601 |
| D391,314 | S | | 2/1998 | Cordero | |
| 5,787,523 | A | * | 8/1998 | Lindberg | 5/81.1 HS |
| 5,809,595 | A | * | 9/1998 | Stevens et al. | 5/653 |
| 6,053,572 | A | * | 4/2000 | Doran | 297/219.1 |
| 6,702,273 | B1 | | 3/2004 | Sellers | |
| D549,031 | S | * | 8/2007 | Berkson | D6/601 |
| 7,270,627 | B2 | | 9/2007 | Hankin | |
| 2004/0172763 | A1 | * | 9/2004 | Sachs et al. | 5/656 |

* cited by examiner

*Primary Examiner* — Robert G Santos
(74) *Attorney, Agent, or Firm* — Daniel Boudwin

(57) ABSTRACT

Disclosed is a physical therapy support, comprising a planar structure having a first and second end and an upper and lower surface that reduces friction between the lower body of a patient and a hospital bed. The device is positioned between a patient's hips and the underlying bed sheets, whereby the patient is elevated and separated from the sheets to allow freedom of movement and increased support when engaging in hip and lower body movements for recovery and physical therapy sessions. The shape of the device includes a first rounded end and a second flat end to form a triangular shape having tapering longitudinal sides. The cross section comprises a thin, rigid and uniform material having a low friction upper surface and a high friction lower surface. A slot penetration along the one of the tapering sides allows for handling of the device and for transporting between patients.

8 Claims, 4 Drawing Sheets

REHABILITATION AND PHYSICAL THERAPY DEVICE

CROSS REFERENCE TO RELATED APPLICATION

This application claims the benefit of U.S. Provisional Application No. 61/608,404 filed on Mar. 8, 2012, entitled "Range of Motion Board." The above identified patent application is herein incorporated by reference in its entirety to provide continuity of disclosure.

BACKGROUND OF THE INVENTION

1. Field of the Invention

The present invention relates to a rehabilitation device that facilitates increased freedom of movement for a recovering patient while in bed. More specifically, the present invention pertains to a patient movement and exercise surface for placement under a patient's hips to allow lower body exercises and therapy to be conducted without interference from blankets or sheets on the bed. The board includes a smooth surface upper surface that allows a patient to be supported above bed sheets and engage in leg and hip rehabilitation activities with minimal friction, while a high friction lower surface keeps the device in place while deployed.

Many knee, hip and other lower body surgeries are conducted each year. When patients undergo a major surgery of this type, they typically require physical therapy in the form of lower body movement and exercise to accelerate recovery, build strength in the affected area and regain full use to the repaired area. These types of surgeries can make a patient bed ridden for significant periods, during which time it is imperative for the patient to remain compliant to any prescribed therapy and exercise routines. Generally this entails working with physical therapists or other health care professionals, or even with family members in the home. Therapy increases blood flow, increases strength, improves range of motion after the surgery and focuses the patient on becoming ambulatory once again.

Many of the therapy routines for patients just after major hip or knee surgery requires the activity to be performed while remaining in bed. This involves first separating the patient from the bed coverings to allow freedom of movement. The patient's inherent weakness after the surgery or in general, combined with bunching or tangling with bed sheets can significantly hinder movement and physical therapy exercises. The patient's legs and hip areas must be separated from the bed to allow different leg and hip motions while preventing the patient from sinking into the mattress or requiring too much traction on the patient. Binding and tangling of the sheets can cause increased friction, reducing patient range of motion, physical exertion and possible discomfort. If a patient cannot conduct the exercises appropriately, recovery time is prolonged and compliance with the exercises is reduced. This can lead to an increase in long term medical costs, future mobility and even quality of life for the patient after the surgery. Patients having hip and knee replacement surgery with inadequate recovery or therapy thereafter can suffer from joint stiffness or lack of a full range of motion, which can result in gait abnormalities and pain.

The present invention provides a means of separating a patient in a bed from the underlying sheets and provides a rigid, planar surface upon which to engage in therapy exercises. The upper surface of the device is low friction to allow easy sliding of the patient's leg thereacross, reducing traction on the patient and allowing full range of motion during sliding and bending exercises. The lower surface of the device is adapted to remain in position on the bed while the device is deployed. The structure of the device includes a first rounded end and a flat second end to form a triangularly tapering section of unitary and thin material. The material forms a rigid or semi-rigid structure that allows a patient to place his or her leg and hip region on the device upper surface to separate the patient from the mattress and sheets. This prevents the patient from tangling in the bed sheets during movement or sinking into the bed. The device is designed to be deployed by physical therapists, nurses and other patient care providers for use with patients after a major lower body surgery or during long term bed stays.

2. Description of the Prior Art

Devices have been disclosed in the prior art that relate to exercise and medical support boards. These include devices that have been patented and published in patent application publications, and generally relate to boards having specific shapes, contours and other features to facilitate exercising thereon, or for patient support in the case of medical support boards. None of the patents discloses a three sided board for insertion beneath a patient to provide a planar surface that reduces friction and surface traction for a patient while engaging in therapeutic recovery exercises after major surgery. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 3,829,914 to Treat discloses a patient positioning device comprising a flexible sheet having a friction-type upper surface and a low friction lower surface. A patient is placed on the upper surface, where the patient stays in position relative to the sheet as the lower surface provides a low friction interface between the sheet and a patient's bed or gurney. Loop handles along the longitudinal ends provide a healthcare practitioner to grip the sheet and forcibly slide the patient with the sheet having increased purchase of the sheet. The sheet and handles can be utilized to lift the patient from the bed and create a soft stretcher two or more individuals could utilize to hand carry a patient if required. The Treat device is a flexible structure having handles for physically sliding a prone patient unable to move themselves without assistance. The structure is not sufficient for enabling a patient to support themselves above a hospital bed and engage in lower body movement during physical therapy. The Treat device is a movement and carrying device.

Another such device is U.S. Pat. No. 4,048,681 to Baulch, which discloses a patient lift board comprising a rigid board adapted to extend from behind a person's head to the base of their hips. The board first side contacts a bedding surface and includes a smooth surface having no protrusions. The board second side includes attached padding therealong to comfortably support a patient's head and spine, while manual engagement openings through the board allows unassisted sliding and lifting movement of a patient by a single practitioner while the patient's head and neck are supported. A wedge member is also disclosed for positioning a patient at an incline using the padded and rigid board. While the Baulch device discloses a medical support board, the Baulch board is concerned with neck and spine support for an injured patient. The board includes padding and is concerned with controlled movement and placement of a patient within a bed without undue movement or stress on the patient's neck. The present invention is a planar surface that supports untangled movements and a surface and reduces traction between the user's hips and a hospital bed mattress. The intent and structure of the Baulch device is significantly different from that of the present invention.

Several design patents have also been disclosed for exercise boards of various shape and construction. These devices fulfill a respective need in the art for exercise supports and surfaces, but fail to disclose an in-bed lower body support surface that assists a patient in hip and knee rehabilitation activities. The present device is structured having a uniform, low friction upper surface to separate the patient's hips from the bedding to facilitate free movement of the hip, leg and knee joint, which allows a health care professional or assistant to more readily lift or slide the patient's hips and legs without entangling the patient within the bed sheets. The device shape is unique in its simplicity, allowing the board to be inserted below a patient's hip and leg with minimal effort or discomfort for the patient, while the high friction lower surface prevents movement of the device while being utilized for exercises.

The present invention comprises a planar structure having a defined shape and surfaces that facilitate lower body movement thereon while a patient is prone or sitting in a bed. The device reduces friction between a patient and the patient's bed while attempting to regain function and range of motion during physical therapy sessions. It is submitted that the present invention is substantially diverges in design elements from the prior art, and consequently it is clear that there is a need in the art for an improvement to existing patient physical therapy devices. In this regard the instant invention substantially fulfills these needs.

SUMMARY OF THE INVENTION

In view of the foregoing disadvantages inherent in the known types of physical therapy devices now present in the prior art, the present invention provides a new physical therapy support that can be utilized for providing convenience for the user when exercising and rehabilitating the lower body after a major surgery or during extended bedridden periods.

It is therefore an object of the present invention to provide a new and improved physical therapy device that has all of the advantages of the prior art and none of the disadvantages.

It is another object of the present invention to provide a physical therapy device that a bedridden patient can utilize to allow full range of motion of the patient's lower body.

Another object of the present invention is to provide a physical therapy device that separates a patient in a bed from the underlying sheets and mattress to provide a low friction surface upon which to engage in lower body exercises and movement.

Another object of the present invention is to provide a physical therapy device that reduces frustration with in-bed exercises and increases compliance with after-surgery or extended-stay prescribed physical therapy.

Another object of the present invention is to provide a physical therapy device that increases recovery time by facilitating in-bed therapy, increasing patient strength and range of motion.

Another object of the present invention is to provide a physical therapy device that reduces overall short-term and long-term medical costs by maintaining patient compliance, reducing recovery time and reducing potential long-term motor function impairments.

Yet another object of the present invention is to provide a physical therapy device that is easily deployed, whereby patients and healthcare providers may utilize the device in a clinic, hospital or even in a patient's home.

Yet another object of the present invention is to provide a physical therapy device that is comprised of simple design and construction that allows inexpensive deployment and production.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
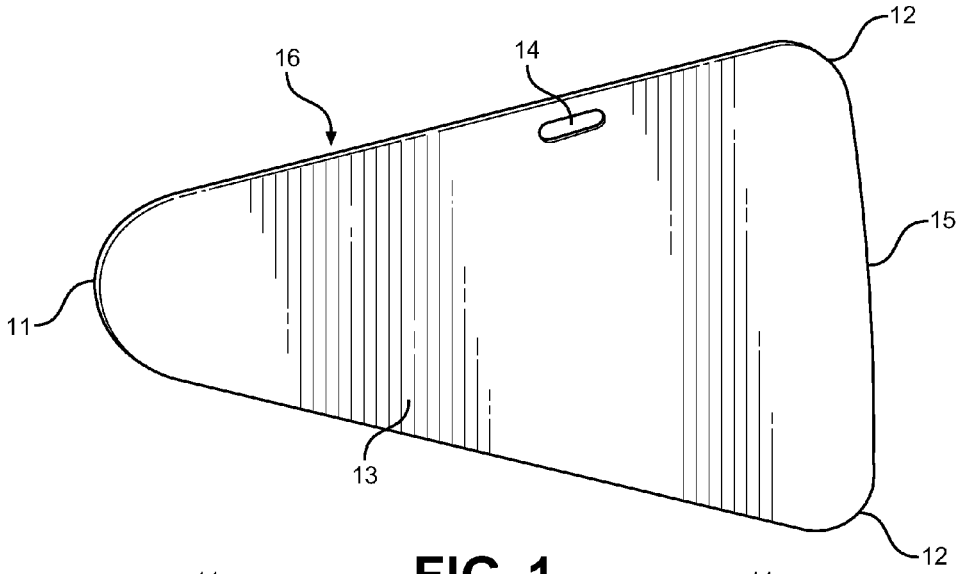
FIG. 1 shows a perspective view of the present invention.
Figure 2:
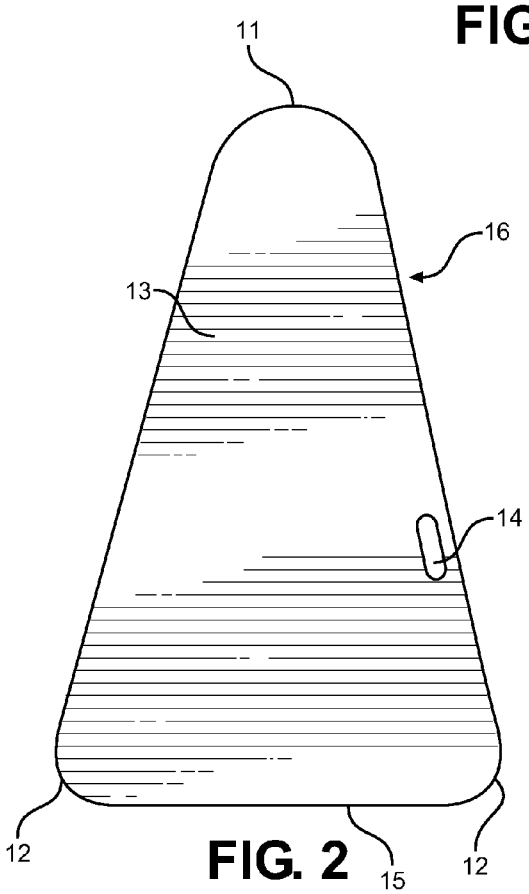
FIG. 2 shows an overhead view of the present invention.
Figure 3:
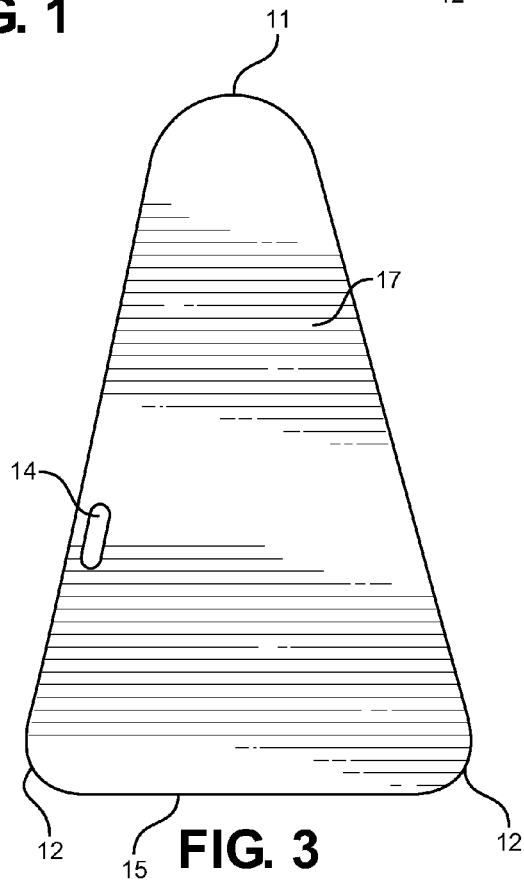
FIG. 3 shows an underside view of the present invention.
Figure 4:
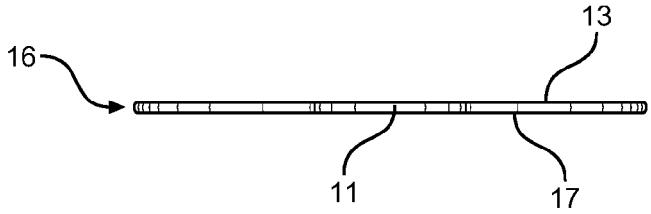
FIG. 4 shows a view of the first end of the present invention.
Figure 5:
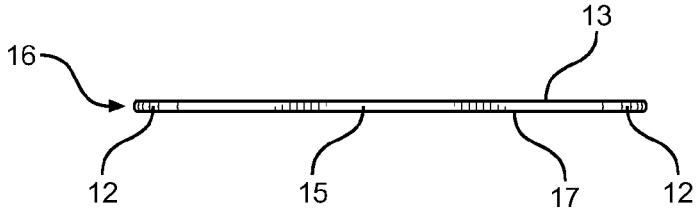
FIG. 5 shows a view of the second end of the present invention.
Figure 6:
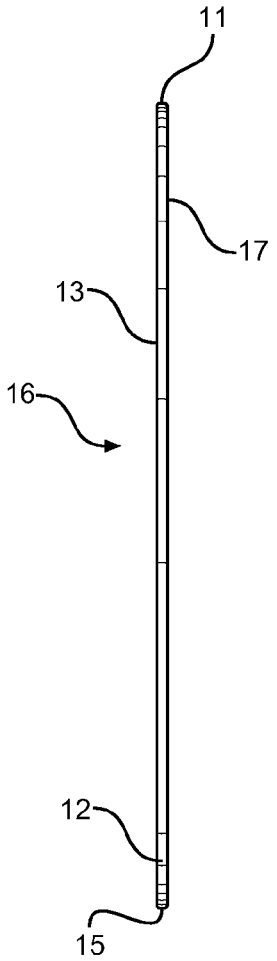
FIG. 6 shows a side view of the present invention.
Figure 7:
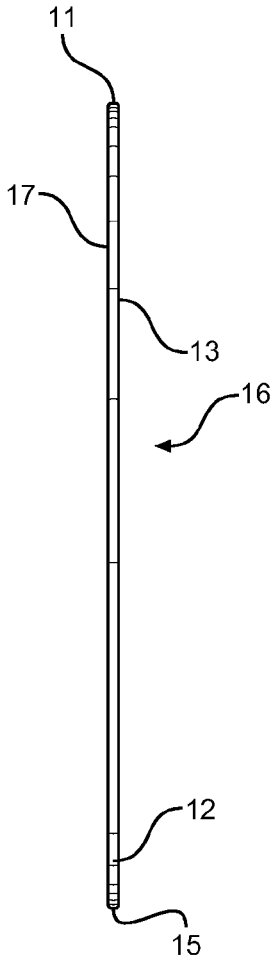
FIG. 7 shows a side view of the present invention.

Reference is made herein to the attached drawings. Like reference numerals are used throughout the drawings to depict like or similar elements of the physical therapy device. For the purposes of presenting a brief and clear description of the present invention, the preferred embodiment will be discussed as used for assisting movement and exercise of patient's lower body while in bed. The figures are intended for representative purposes only and should not be considered to be limiting in any respect.

Referring now to FIGS. 1 through 7, there are shown views of the physical therapy device 16 of the present invention. The device comprises a thin, planar structure having a first end 11, a second end 15, an upper surface 13 and a lower surface 17. The first end 11 comprises a rounded portion that is adapted to be placed beneath a patient's hip or buttocks region and between the patient and the patient bedding. The second end 15 comprises a widened area having rounded edges 12 that create a radius leading to the sides of the device. Between the first and second end are the tapering sides that establish the boundary of the support surface, starting with a widened second end 15 and tapering inwards toward the first end 11 to define a largely triangular shape. The tapered shape provides a support surface upon which a user may easily slide, rotate or otherwise move his or her leg thereon without easily extending lower body movement beyond the boundaries of the widened area of the device. The first end 11 is placed at the hip region or upper leg area of the patient, while the widened second end 15 provides extended lateral area to accommodate full range of motion during physical therapy exercises.

The device comprises an upper and lower surface having distinct objectives. The upper surface 13 is a smooth, low friction surface upon which a patient may slide his or her knee, heel or other lower body portion therealong with minimal resistance. The lower surface 17, by contrast, is a high friction underside of the device that is adapted to be placed in contact with the patient's bed or bed sheets. Once the device is placed on the bed, the lower surface 17 provides a high friction interface that resists sliding or dislodging of the device while the user is engaging in movements along the device upper surface 13. The lower surface may include a high friction surface texture, a tacky surface treatment, or may include an alternate material such as felt that increases the coefficient of friction between the bed and the device to resist unwanted movement.

The device is a planar surface upon which exercises and physical therapy movements can be conducted upon while a patient remains prone or in a seated position. A healthcare provider or caretaker can carry the board using a slotted penetration 14 that forms a hand grip along one side of the board. When deploying the device, the device 16 is laid flat on the bed and the first end 11 is positioned below the patient's hip or upper leg region. The second end 15 of the board provides an extended area to allow inward and outward leg movement, while the low friction surface facilitates ease of leg movement therealong without requiring the patient to lift their leg from the bed or overly burden themselves during movements. The goal is to facilitate movement of the patient's lower body for recovery purposes, whereby friction and interference with bedding is eliminated, and full range of motion of the patient's leg is provided for across the enlarged upper surface 13 of the device.

Figure 8:
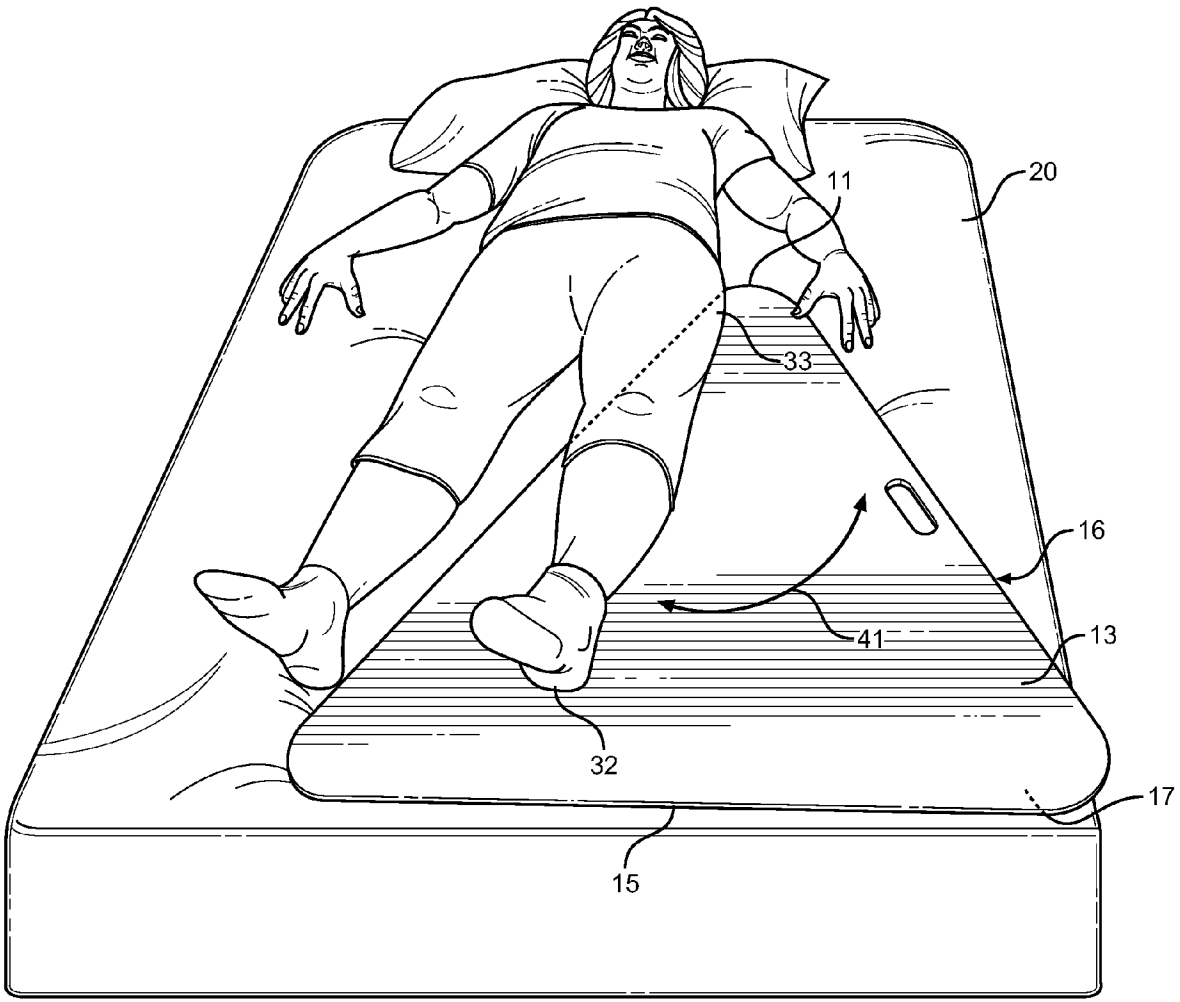
FIG. 8 shows a view of the present invention in a working state.
Figure 9:
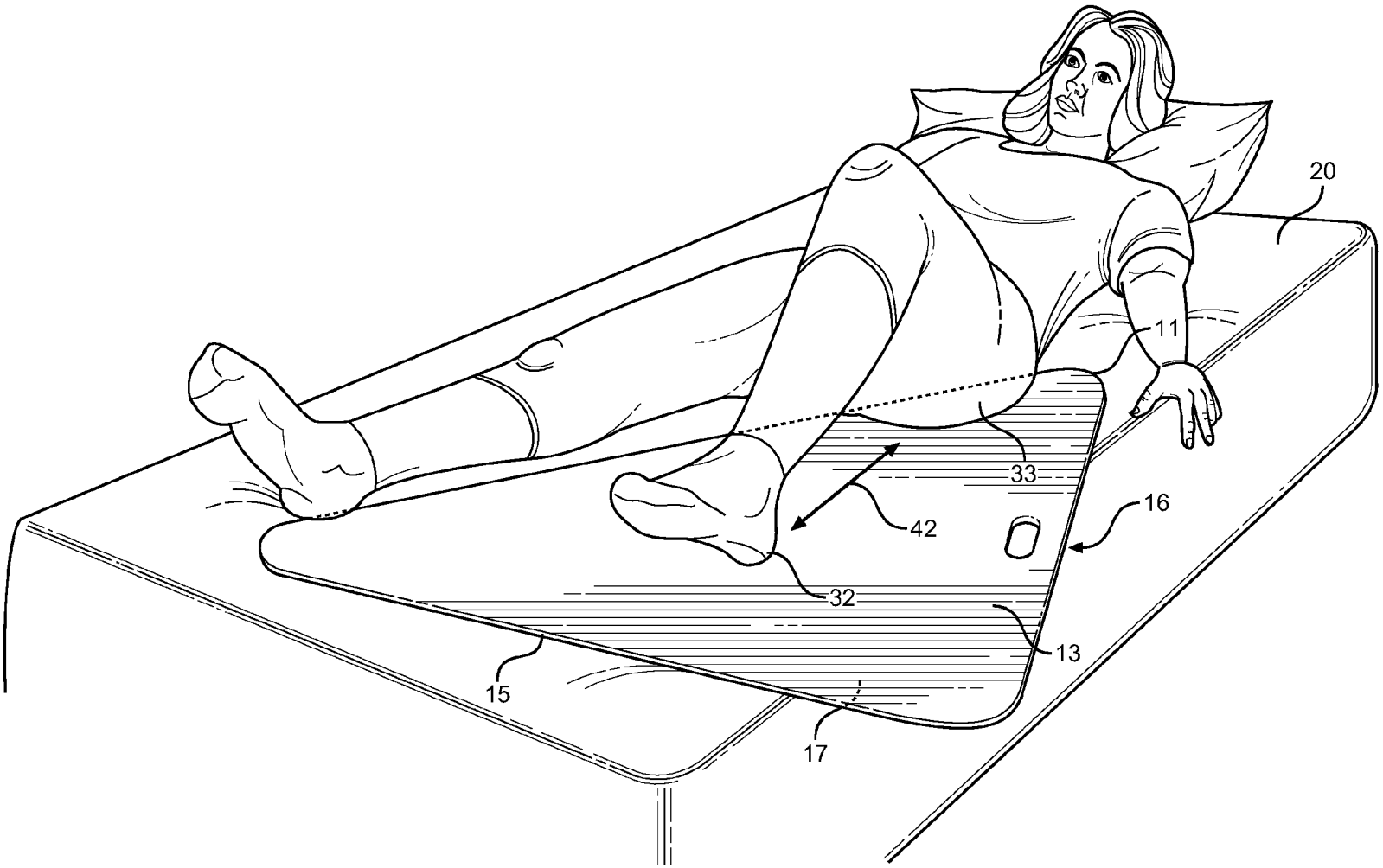
FIG. 9 shows another view of the present invention in a working state.

Referring now to FIGS. 8 and 9, there are shown views of the present invention 16 in a working state, positioned below a patient and separating one of the patient's legs from the underlying bed 20. When deployed, the first end 11 is placed beneath the patient's upper leg or buttocks region 33, while the wider second end 15 is placed towards the patient's foot 32. The wide second end 15 provides an enlarged area upon which the user can engage in leg movement 41, 42 with minimal resistance. A common exercise after hip replacement surgery involves a heal-out slide 41 that creates movement in the hip joint region 33. The widened lower portion 15 of the device and the slick upper surface 13 allow the patient to slide their heel 32 outward 41 with minimal interference or resistance, which would otherwise be very difficult for the patient without the device 16. A common exercise after knee and hip surgeries is a heel slide 42, whereby the knee is flexed and brought upward as the patient's heel 32 is slid toward the buttock region 33. The patient's muscle weakness, joint stiffness and related pain would otherwise prevent full range of motion without separation from the bed 20 during these types of exercises. During the leg movements, the low friction upper surface 13 provides a sliding interface, while the high friction lower surface 17 maintains the device 16 position on the bed 20 and prevents unwanted sliding or shifting.

When patients undergo knee or hip surgery, they typically require physical therapy to ensure proper recovery and regain full mobility. However, for a time the routines have to be performed while in bed and require the patient to move his or her leg or foot across the surface of the bed. The sheets get in the way of the therapy, and if a patient does not make progress, the recovery time may be extended, increasing overall medical costs. The patient may not get back to functionality as a result, which can reduce mobility and reduce the patient's quality of life in the long run. Stiff joints or lack of a full range of motion can result in gait abnormalities, increased pain or necessitate ambulatory assistance. The design of the device facilitates full range of motion of leg and hip joints, where the enlarged surface area of the board allows outward sliding and rotating motion of the patient's lower body without entangling with bedding material.

The present invention describes an exercise and physical therapy board used to increase range of motion for such patients. The device comprises a two-sided planar board having a general triangular shape, and can be used while in a bed after surgery and during rehabilitation. The present device makes it easier for patients to perform his or her exercises by reducing the potential of snagging the foot in the bedding sheets and blankets. The construction of the device requires a thin, planar board material having a unitary or composite cross section. Materials contemplated for the board include masonite and high density polyethylene material (HTPE); however it is not desired to limit the construction of the present invention to a specific subset of materials, but rather it is desired to disclose a functioning rehabilitation and physical therapy device having structural elements for which an adequate construction may later be designed, taking into account producability, cost and user safety.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A rehabilitation and physical therapy device, comprising:

a substantially rigid planar surface having a first end, a second end, an upper surface, a lower surface and a thickness;

said first end comprising a rounded termination;

said second end comprising a widened termination with respect to said first end;

said planar surface having tapering sides between said first and second end forming a generally triangular shape;

an aperture along at least one of said surface sides forming a handgrip;

said upper surface comprising a low friction surface;

said lower surface comprising a high friction surface.

2. The device of claim 1, wherein said second end termination and said sides transition comprises a rounded corner having a radius.

3. The device of claim 1, wherein said high friction lower surface further comprises a textured surface.

4. The device of claim 1, wherein said high friction lower surface further comprises a tacky surface treatment.

5. The device of claim 1, wherein said high friction lower surface further comprises a high friction material secured thereto.

6. The device of claim 5, wherein said high friction material further comprises felt material.

7. The device of claim 1, wherein said planar surface thickness further comprises a unitary material construction.

8. The device of claim 1, wherein said planar surface thickness further comprises a material composite construction.

* * * * *